US008844727B2

(12) United States Patent
Buhagiar

(10) Patent No.: US 8,844,727 B2
(45) Date of Patent: Sep. 30, 2014

(54) COMPACT PACKAGE FOR A PALLET DISPLAY

(75) Inventor: Anthony Buhagiar, Aurora, IL (US)

(73) Assignee: Excel Container, Inc., Aurora, IL (US)

( * ) Notice: Subject to any disclaimer, the term of this patent is extended or adjusted under 35 U.S.C. 154(b) by 157 days.

(21) Appl. No.: 13/590,765

(22) Filed: Aug. 21, 2012

(65) Prior Publication Data

US 2014/0054197 A1 Feb. 27, 2014

(51) Int. Cl.
*B65D 5/52* (2006.01)
*A47F 5/11* (2006.01)

(52) U.S. Cl.
CPC .... *B65D 5/52* (2013.01); *A47F 5/11* (2013.01)
USPC ..... 206/736; 206/730

(58) Field of Classification Search
CPC ..... B65D 5/52; B65D 5/5213; B65D 19/20; B65D 2519/00019
USPC ..... 206/736, 730, 735, 600, 756
See application file for complete search history.

(56) References Cited

U.S. PATENT DOCUMENTS

| | | | | |
|---|---|---|---|---|
| 4,085,847 | A * | 4/1978 | Jacalone | 206/600 |
| 7,273,149 | B2 * | 9/2007 | Lutes et al. | 206/768 |
| 7,290,664 | B2 * | 11/2007 | Kono et al. | 206/600 |
| 2013/0327680 | A1 * | 12/2013 | Reynolds et al. | 206/600 |

* cited by examiner

*Primary Examiner* — David Fidei
(74) *Attorney, Agent, or Firm* — Ice Miller LLP

(57) ABSTRACT

A package that may be constructed into a point of purchase display includes a plurality of bottom uprights set in a tray, and a plurality of top uprights that are kept in folded form in a space between the bottom uprights. The top uprights are assembled and placed on top of the bottom uprights to form a completed display. The bottom uprights may contain shelves with product stocked thereon, and the space between the bottom uprights may contain product to be stocked on the top uprights after the top uprights are assembled on top of the bottom uprights. The top uprights may be assembled and placed on top of the bottom uprights by a retailer or other end user without requiring glue or fasteners.

13 Claims, 10 Drawing Sheets

COMPACT PACKAGE FOR A PALLET DISPLAY

FIELD OF THE INVENTION

The present invention relates to pallet displays for books, magazines, or other shelved merchandise.

BACKGROUND

Pallets are commonly used to ship large quantities of products. For instance, manufacturers may load products onto pallets for transport from manufacturing facilities to warehouses or distribution centers, and then for further transport from warehouses or distribution centers to the manufacturer's customers, such as retailers. Although retail stores generally stock their goods in purchasing aisles grouped by product category, retailers may use the pallets on which products are shipped for in-store display of the products in the larger aisles that are generally not dedicated to a given product category. Such larger aisles of the store generally are predominantly provided for consumer travel to access the dedicated purchasing aisles.

The use of pallets in such manner provides various cost savings to both the retailers and the manufacturers. For instance, the pallet loaded with products may be deposited (e.g., by fork lift) directly at the display location in the store, rather than deposited in the stock room, back room, or inventory, thus freeing up space in the retailer's stock room. Employees need not expend time and energy transporting cartons of the product from the stock room to a shelf (or other display area) at a merchandising location. Because larger quantities of a product may be displayed on a pallet than on a typical store shelf, less time and effort is expended in restocking the display for the product, In fact, products typically are shopped down from a pallet and not restocked. Moreover, because larger quantities of a product may be displayed on a pallet than on a typical store shelf, all products remain on the pallet and the retailer need not dedicate stock room space to store products (as would be the case if such products were displayed on a shelf which cannot accommodate the full pallet-load of products). Once the display is largely sold down/sold through, the stock from a promotional display may be placed in the home location of the product.

Manufacturers benefit from having their products displayed on a pallet because pallets typically draw consumer attention by virtue of their mass and stand-alone location along the larger aisles or main drive aisles of the store generally traveled to access the purchasing aisles. The display of products on pallets positioned in a main drive aisle induces impulse purchases, not only because such displays tend to grab consumer attention, but also because the product is positioned for higher visibility. More particularly, there is more foot traffic (and thus a greater number of potential shopper pass such display) in a main drive aisle because consumers typically circulate through the store by walking the perimeter or main drive aisle.

In order to enhance saleability and the attention-grabbing aspect, including the visual impact/aesthetic impact, stopping power, or signature-personality (see and remember quality) of displaying products on pallets, manufacturers may utilize pallet displays, which are a type of display designed to rest on a pallet (or at least to be set among other pallets used to display products). Pallet displays permit the efficient shipping and rollout to sales floors provided by simply displaying products on a pallet, yet also permit various additional benefits. One significant benefit of pallet displays is that they may be designed to have various features that attract consumers. For instance, pallet displays generally contain sufficient panels or "billboard" space or printable surface area for graphics, product imagery, branding (e.g., logos), consumer education, or other messaging and communications. Generally, more information may be provided on a pallet display than at the home location for the product (on a shelf in the aisle dedicated to the product category for such product). Structural elements may also be provided to enhance the display (such as by providing additional graphics, etc., or audio-visual effects, etc.). Likewise, the pallet display may have a unique shape or configuration enhancing display of the products. Pallet displays thus are generally more aesthetically appealing than displays of products merely stacked on a pallet.

Pallet displays can incur challenges in shipping. For example, four-sided shelved pallet displays are used for books, and are often between 50 and 60 inches height for visibility. Such tall displays cannot be double stacked in a standard 100 inch tractor trailer for shipping. Because of this, tall pallet displays can only be single stacked in a tractor trailer, which leaves a great deal of wasted freight space, resulting in higher shipping costs for the manufacturer. It would be desirable to design a pallet display that, while tall enough to grab attention in a store, can be shipped compactly. It would also be desirable that such a pallet display be easily assembled from the compact shipping package.

SUMMARY OF THE INVENTION

In an embodiment according to the invention, a compact package for a point-of-purchase display comprises a tray; a plurality of bottom uprights disposed in the tray such that at least one space is formed between the bottom uprights; and a plurality of top uprights in disassembled form that are at least partially stowed in the at least one space between the bottom uprights. Each of the top uprights may be removed from the at least one space between the bottom uprights, then assembled and secured on top of one of the bottom uprights to form assembled uprights in a point-of-purchase display. In a further embodiment, the bottom uprights have products for display contained therein, and products for display on the top uprights are stowed in the at least one space between the bottom uprights. The products for display on the top rack may stored in boxes having hand holes inside the space.

In some embodiments, the top uprights may be secured to the bottom portions without adhesive or external fasteners. A top upright may be secured to a bottom upright at least partially using flanges and slots. In one embodiment, the bottom upright has flanges extending upward that may be inserted into female slots on the top upright. In a related embodiment, a top upright is secured to a bottom upright at least partially using tabs on the top upright that fit on opposite sides of a panel on the bottom upright. The top upright may have a center tab and two side tabs extending downward from the top upright, the center tab extending further downward than the two side tabs, and the center and side tabs fit on opposite sides of a panel on the bottom upright.

The aforementioned package may also have a shroud and a cap for enclosing the package for transport, or be constructed essentially of corrugated board. The aforementioned package may be sized to be double-stacked on a standard tractor trailer. The package may also include graphic panels that may be applied to the assembled uprights that cover seams where the top upright is secured to the bottom upright. The package may also include a panel stowed in the package that may be unfolded and placed on top of the assembled display to cover any space between the top uprights.

BRIEF DESCRIPTION OF THE DRAWINGS

Embodiments of the invention will now be explained in further detail by way of example only with reference to the accompanying figures, in which.

DETAILED DESCRIPTION OF THE INVENTION

Figure 1:
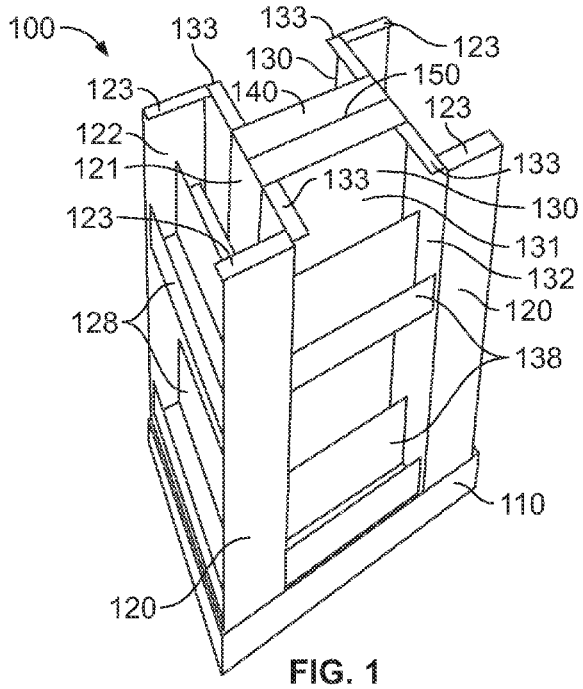
FIG. 1 is a view of the interior of an embodiment of the display package prior to assembly into a display.

FIG. 1 shows the interior of a display package 100, as it would be typically shipped by a manufacturer or distributor to an end user (typically a retailer). The display may be constructed of appropriate weights of corrugated board or similar material. The display comprises a rectangular bottom tray 110, in which two large bottom uprights 120 and two small bottom uprights 130 are set, which each upright 120 and 130 facing one outer edge of the bottom tray 110. The bottom tray 110 is made of corrugated board or like material, and may be sized to fit on a pallet. Each upright 120 and 130 in this embodiment is a partial box having back panels 121 and 131, respectively and each upright 120 and 130 has two side panels 122 and 132. The back panels 121 and 131 may have false backs 125 and 135 lain over the back panels. The bottom uprights 120 and 130 each have a height, width, and depth, here the height of the large bottom uprights 120 and small bottom uprights 130 are roughly equal. The height of the bottom uprights ideally is such that the package can be double-stacked in a standard tractor trailer, and thus the height of the bottom uprights is ideally under 45 inches. In this embodiment, each bottom upright 120 or 130 has at least one shelf 128 or 138 that extends across the width of the upright 120 or 130, and which fits within the depth of the upright 120 or 130. The display may be shipped with products to be displayed already placed on the shelves 128 and 138 of uprights 120 and 130.

Each of the small and large bottom uprights 120 and 130 incorporate flanges 123 and 133 at the top of the uprights, the flanges extending along the depth of each of the uprights 120 and 130. In FIG. 1, the flanges 123 and 133 are oriented perpendicular to the height of the uprights 120 and 130, so as to reduce the vertical height of the package 100 when shipping. However, the end user, in assembling the display, will turn each of the flanges 123 and 133 upright so that they are parallel with the height of the bottom uprights 120 and 130. In this manner, the flanges will be set to mate with top uprights 170 and 180.

Figure 1A:
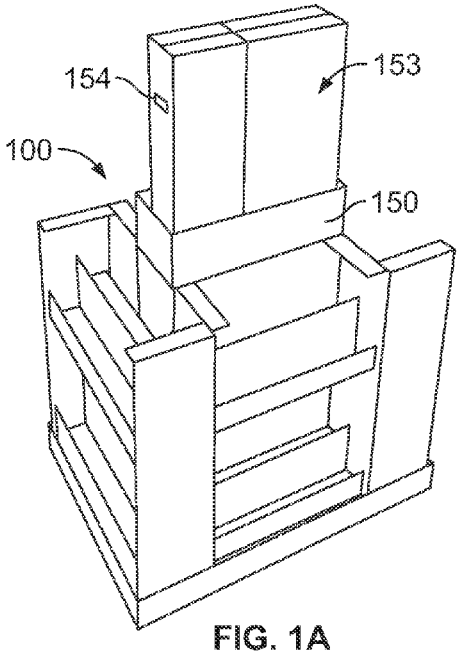
FIG. 1A is a view of the interior of the display package showing the location of products inside the display package.
Figure 1B:
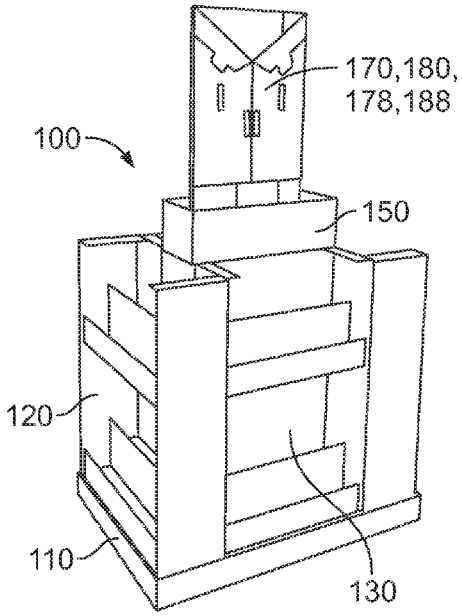
FIG. 1B is a view of the interior of an embodiment of the display package showing the location of parts of the top part of the display.
Figure 1C:
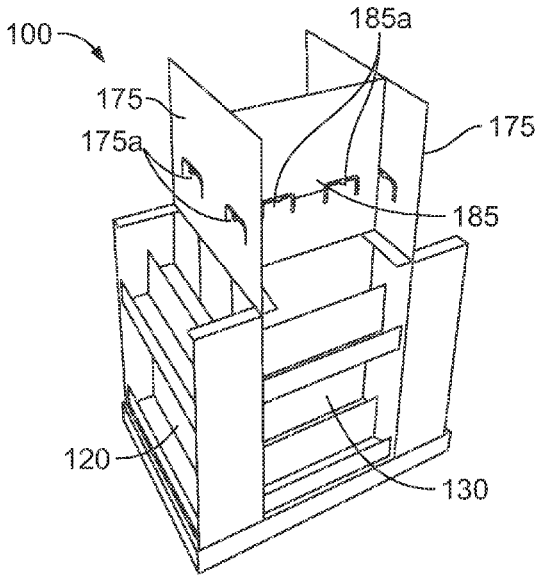
FIG. 1C is a view of the interior of an embodiment of the display package showing the location of false backs for the top part of the display

In this configuration, the two large display uprights 120 extend all the way across opposite sides of the tray 110. The two small bottom uprights 130 extend part way across the other two sides of the tray 110, fitting in the space left by the depth of the large bottom uprights 120. This design leaves a center space 140 in the display, which space may be filled by a shipper filler 150. As shown in FIG. 1A, the shipper filler 150 may contain boxes 153 with product to be stocked on the top portion of the display 110. These boxes 153 may contain hand holes 154 to assist in removing the products from the shipper filler. As shown in FIG. 1B, the shipper filler 150 also contain top large uprights 170 and top small uprights 180 in flat, folded form.

Figure 2A:
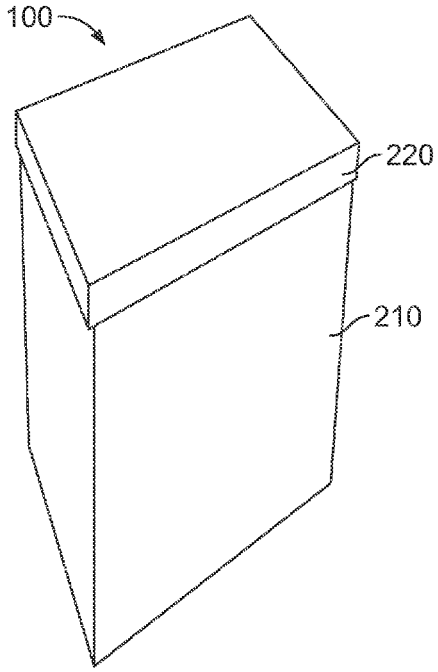
FIG. 2A is a view of the exterior of an embodiment of the display package during shipping.
Figure 2B:
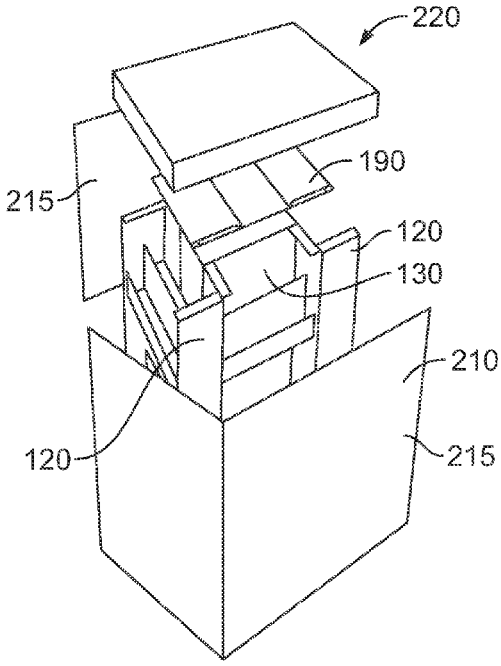
FIG. 2B is an exploded view of the exterior of an embodiment of the display package during shipping.

FIGS. 2A and 2B shows the exterior of a display package 100. FIG. 2A shows the package 100 having a shroud 210 surrounding the tray 110 and bottom uprights 120 and 130, and a top cap 220. As shown in FIG. 2B, the shroud 210 may be comprised of two folded panels 215 which together cover the tray 110 and bottom uprights 120 and 130. The shroud 210 is held in place by top cap 220. Also shown in FIG. 2B is an H-piece 190 in folded form which, as shown later, is used to finish the assembly of a display.

The end user, having received the package 100, removes the cap 220 and shroud 210, sets aside the H-piece 190 that is set on top of the bottom uprights 120 and 130. The end user opens the shipper filler 150 and removes large top uprights 170 and small top uprights 180, which are in flattened form inside the shipper filler. The end user removes boxes 153 containing product from the shipper filler, The user may also remove a plurality of large top shelves 178 and small top shelves 188, which are contained in flattened form. As shown in FIG. 11C, the user may also remove two large false backs 175 and two small false backs 185 to be used in completing the assembly of large top uprights 170 and top small uprights 180. The large false backs 175 are lodged in the interstices between the large bottom uprights 129 and the shipper filler 150. The small false backs 185 are lodged in the interstices between the small bottom uprights 130 the shipper filler 150. The end user may also remove four graphic panels 200 that are stowed along the bottom tray 110 (not shown). As seen above, large and small false backs 175 and 185 each have two U-locks 175*a* and 185*a*, which are upside down U shaped cutouts. These U-locks 175*a* and 185*a* can be used to support shelves 178 and 188 in the assembled top uprights 170 and 180.

Figure 3:
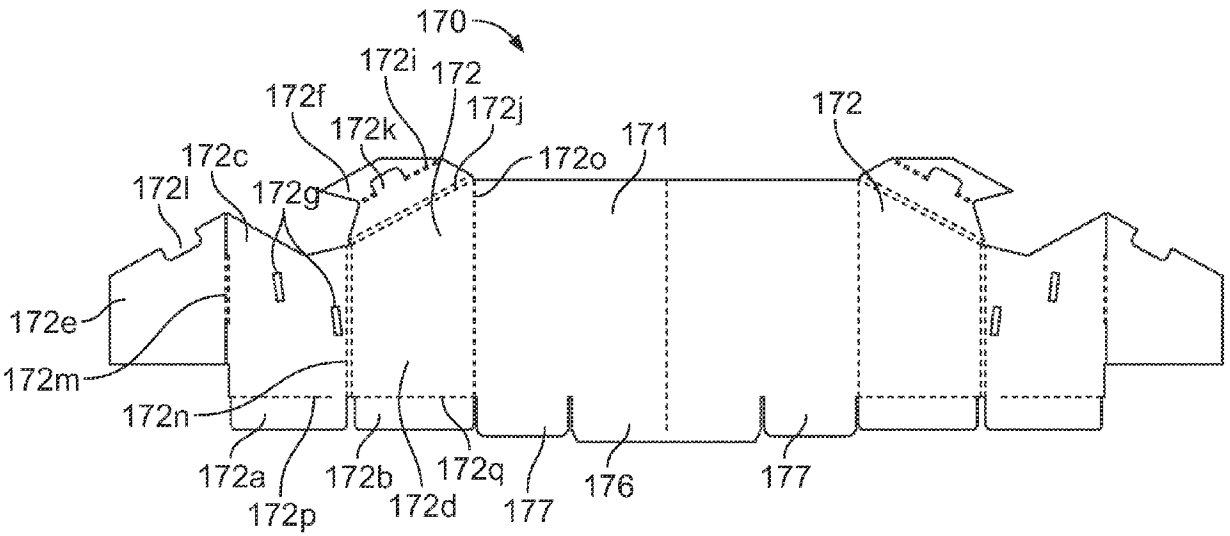
FIG. 3 is a view of a large top upright of an embodiment of the display package prior to assembly.

FIG. 3 shows a large top upright 170 in unassembled form. Large top upright 170 has a back panel 171, side panels 172, center tab 176, and side tabs 177. The center tab 176 and side tabs 177 extend downward from back panel 171, with the center tab 176 extending slightly lower than side tabs 177, for ease in installation. Each side panel 172 is formed of several subpanels that are assembled, partly at the manufacturer or distributor's facilities, and partly by the end user. Bottom lip panels 172*a* and 172*b* are folded onto clip subpanel 172*c* and outer subpanel 172*d*, over lines 172*p* and 172*q* respectively, and glued. This gluing would typically be done at the facilities of the manufacturer of the package, not the end user. Top lip subpanel 172*f* is folded onto itself along line 172*i* and glued to itself, and then top lip subpanel 172*f* is folded over outer subpanel 172*d* along line 172*j* and glued at the manufacturer's facilities. In this embodiment, top lip subpanel 172*f* has a key tab 172*k* that will mate with locking indent 172*l* on inner subpanel 172*e*. The glued but unassembled large top upright 170 is folded and stowed in shipper filler 150 to be assembled by the end user. The clip subpanel 172*c* has holes 172*g* to secure female clips 410 (shown in FIG. 4A) for a shelf 178.

Figure 4A:
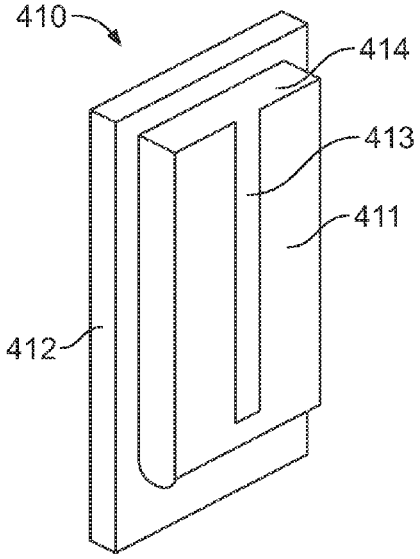
FIG. 4A is a view of a female clip incorporated in an embodiment of the invention.
Figure 4B:
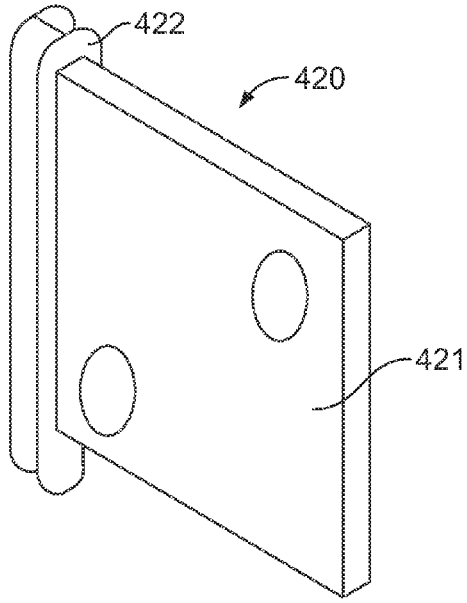
FIG. 4B is a view of a male clip incorporated in an embodiment of the invention.

FIG. 4A shows a female clip 410 of the type that may be used to secure a shelf. The clip 410 has a retainer portion 411 that is sized to fit through hole 172*g*, and a back stop 412. The retainer portion has a lengthwise slot 413 that is open at a top end 414. FIG. 4B shows a male clip 420. The male clip has a body 421 and an H-profile slide 422. The slide 422 fits securely into the lengthwise slot 413 of the female clip 410 when it is slid through the top end 414. The body 421 may be glued to a shelf.

Figure 5A:
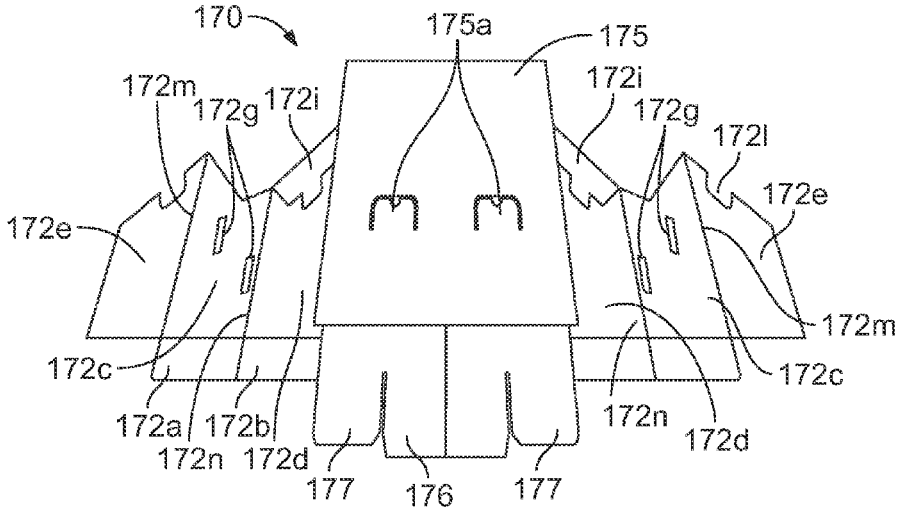
FIGS. 5A-5G are a front view of a top upright of an embodiment of the invention as it is assembled for a display.
Figure 5B:
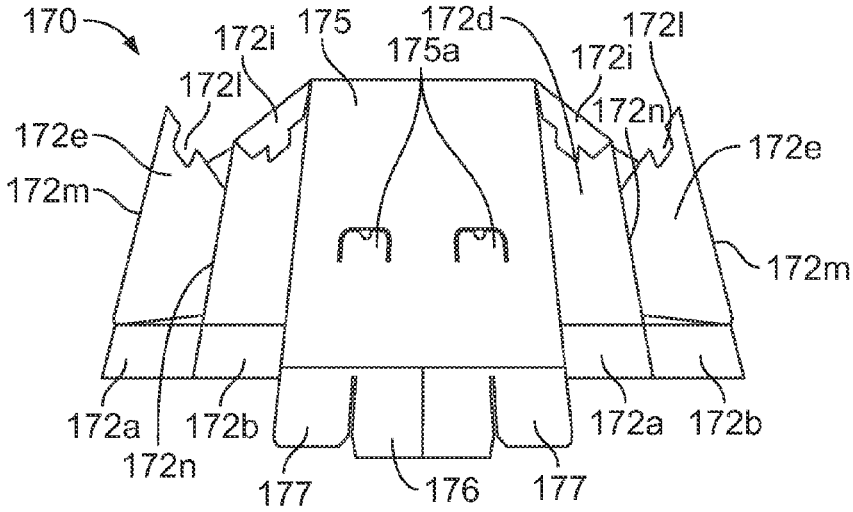
Figure 5C:
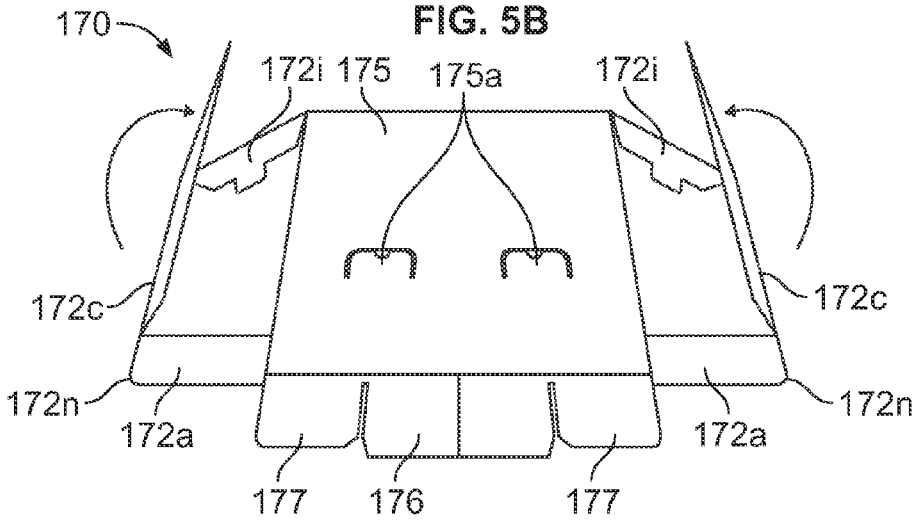
Figure 5D:
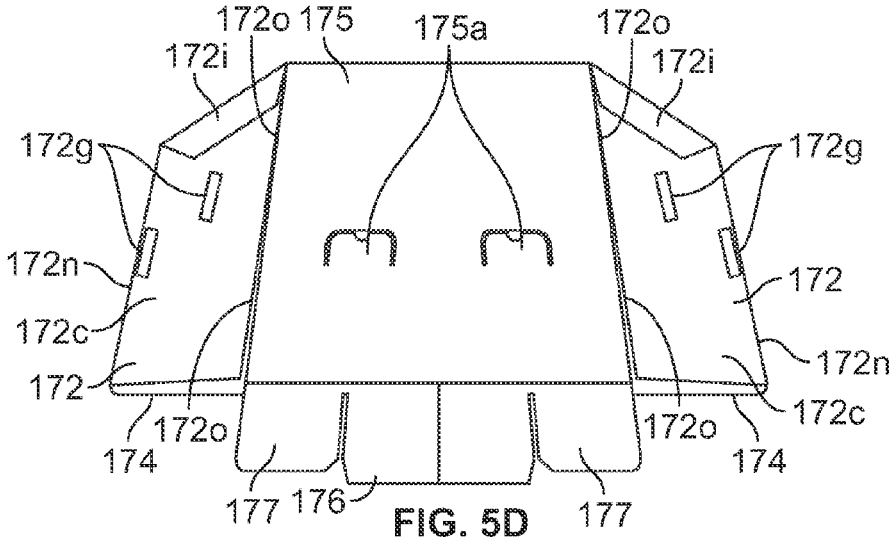

FIGS. 5A-5G shows assembly of a large top upright 170 by the end user. A large false back 175 is placed on top of back panel 171 as shown in FIG. 5A. The end user folds inner subpanel 172*e* onto clip subpanel 172*c* over line 172*m* as shown in FIG. 5B. The end user then folds the combined clip subpanel 172*c* and inner subpanel 172*e* onto outer subpanel 172*d* along line 172*n* as shown in FIG. 5C. In this fashion, the key tab 172*k* interlocks with locking indent 172*l*. The resulting folded panel, as shown in FIG. 5D, has female slots 174 at the bottom of side panels 172.

Figure 5E:
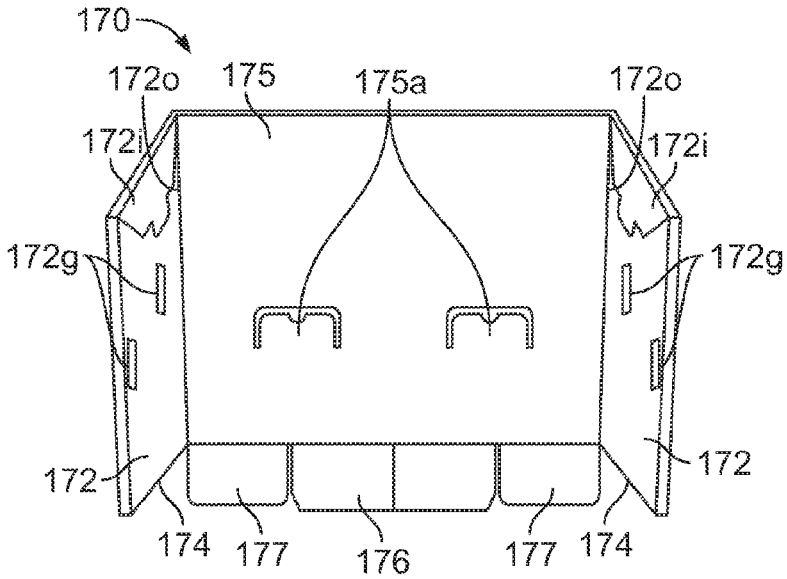

In FIG. 5E, the side panels 172 are folded 90 degrees over line 172*o* to form a U shape with the back panel 171 and false back 175.

Figure 5F:
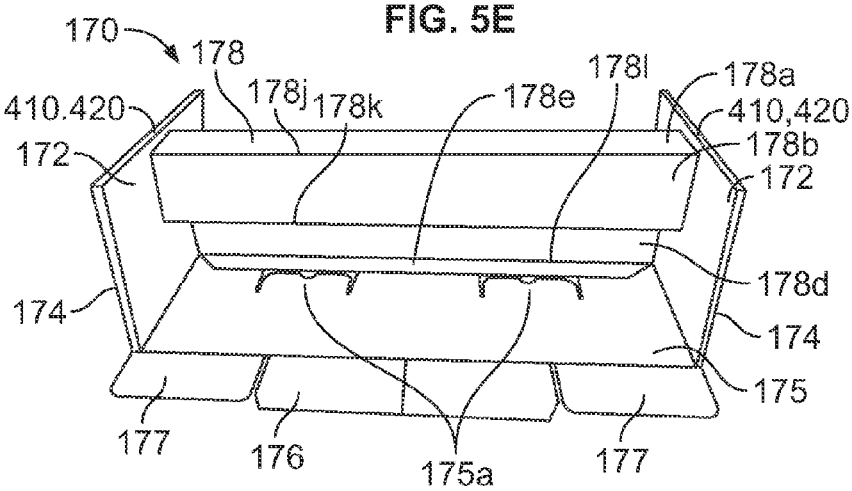
Figure 5G:
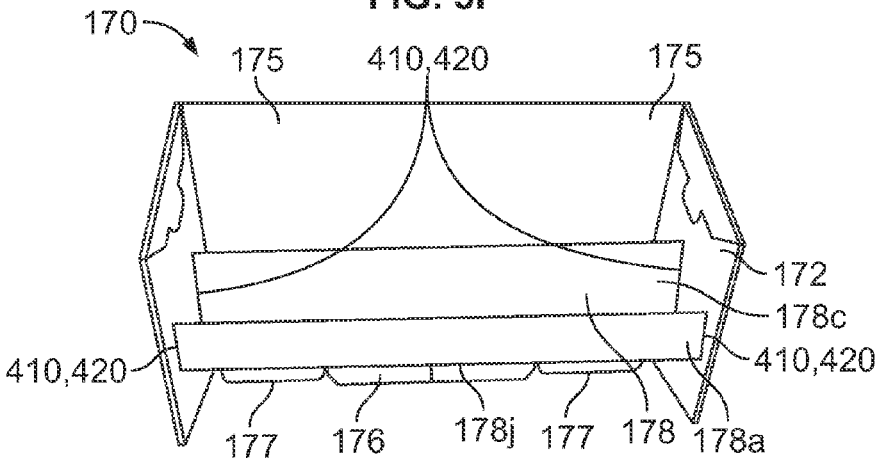

FIGS. 5F and 5G show the installation of shelf 178. The shelf 178 is two-tiered, having a front lip portion 178*a*, a front well portion 178*b*, a rear lip portion 178*c*, and rear well portion 178*d*, and a flange 178*e*, which extends downward from the back edge of the rear well portion 178*d*. Male clips 420 are glued to the ends of first wall portion 178*a* and second wall portion 178*b*. These male clips 420 slide into female clips 420 that were mounted on side panels 172 of top upright 170. The flange 178*e* points downward and fits into the U-locks 175*a* of the false back 175 to form a completed large top upright 170. The completed large top upright 170 can be fit onto a large bottom upright 120 as described below.

Figure 6:
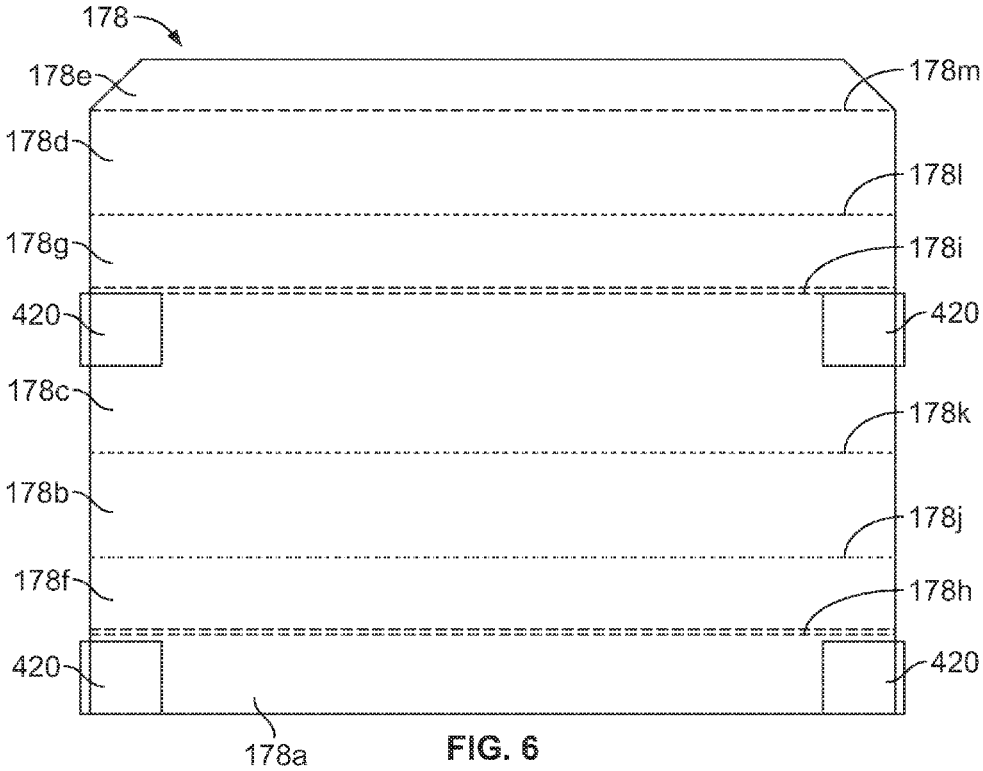
FIG. 6 is a view of a shelf of an embodiment of the invention prior to assembly.

The shelf 178 may be partly assembled and glued by the manufacturer, then packaged in the shipper filler 150. FIG. 6 shows a shelf 178 before assembly. The shelf 178 has seven subpanels, a front lip 178*a*, a front lip backer 178*f*, a front well portion 178*b*, a rear lip portion 178*c*, a rear lip backer 178*g*, a rear well portion 178*d*, and flange 178*e*. The manufacturer glues two male clips 420 on the ends of front lip 178*a*, then folds front lip 178*a* onto front lip backer 178*f* over line 178*h*. The manufacturer glues two male clips 420 at the ends of rear lip portion 178*c* adjacent to line 178*i*. The manufacturer then folds and glues rear lip backer 178*g* onto rear lip portion 178*c* over line 178*i*. The glued and folded shelf 178 can be flat packed in shipper filler 150 to be completed by the end user.

The end user folds along lines 178*j* and 178*k* so that the front well portion 178*b* forms a horizontal floor between vertically oriented front lip portion 178*a* and vertically oriented rear lip portion 178*c*, as shown in FIGS. 5F and 5G. The end user then folds the shelf along lines 178*l* and 178*m* so that rear well portion 178*d* forms a horizontal floor behind vertically oriented rear lip portion 178*c*, and the flange 178*e* extends downward from well portion 178*d*, as shown in FIGS. 5F and 5G. In this configuration, the shelf 178 can be installed in top upright 170 as described above.

Figure 7:
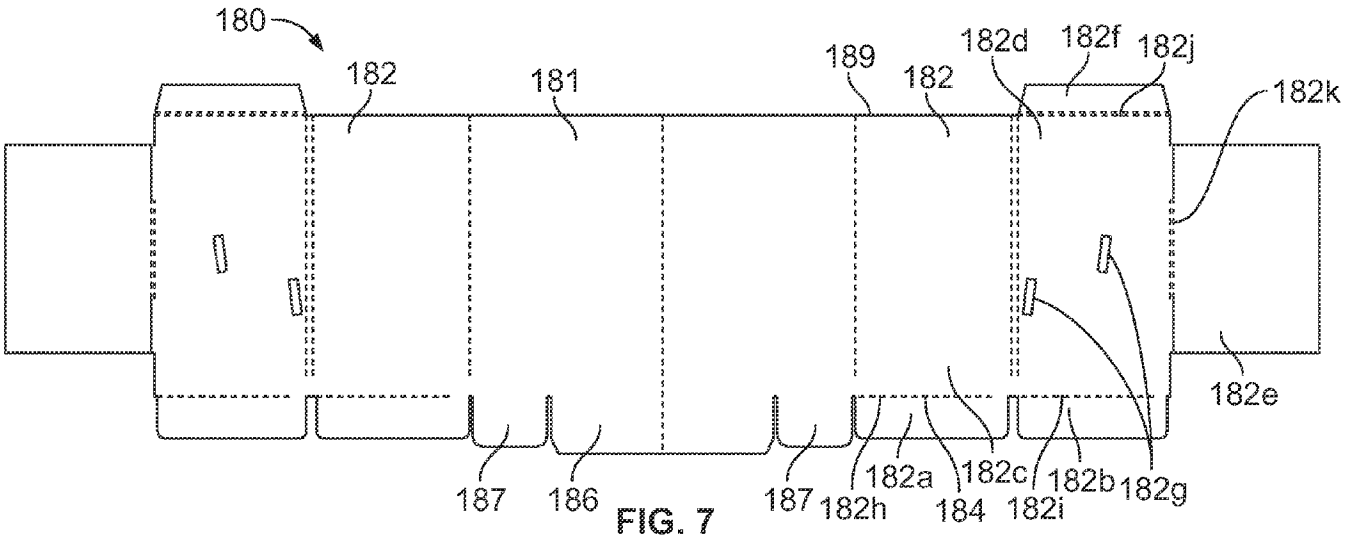
FIG. 7 is a view of a small top upright according to an embodiment of the invention prior to assembly.

The small top uprights 180 are assembled in a manner similar to the large top uprights. FIG. 7 shows a small top upright 180 in unassembled form with back panel 181, side panels 182, center tab 186, and side tabs 187. Side panels 182 are formed of several subpanels that are assembled to complete the display. Bottom lip panels 182*a* and 182*b* are folded onto clip subpanel 182*c* and outer subpanel 182*d* over lines 182*h* and 182*i*, and glued. Top lip panel 182*f* is folded onto outer subpanel 182*d* over line 182*j* and glued. Ideally, these gluing steps are carried out by the manufacturer. Female clips 410 are installed in holes 182*g*, and the unassembled upright 180 is folded and packed inside shipper filler 150. The end user, after removing the small top upright, folds inner subpanel 182*e* onto clip subpanel 182*d* over line 182*k*, then folds clip subpanel 182*d* over outer subpanel 182*c*. Each finished side panel 182 has a bottom female slot 184 and a top female slot 189 formed between the folded subpanels. The end user lays a false back 185 on the back panel 181, folds side panels 182 by 90 degrees, and installs a shelf 188 in the same manner as described with respect to large top upright 170. The shelf 188 is identical to shelf 178 in all respects except size.

Figure 8:
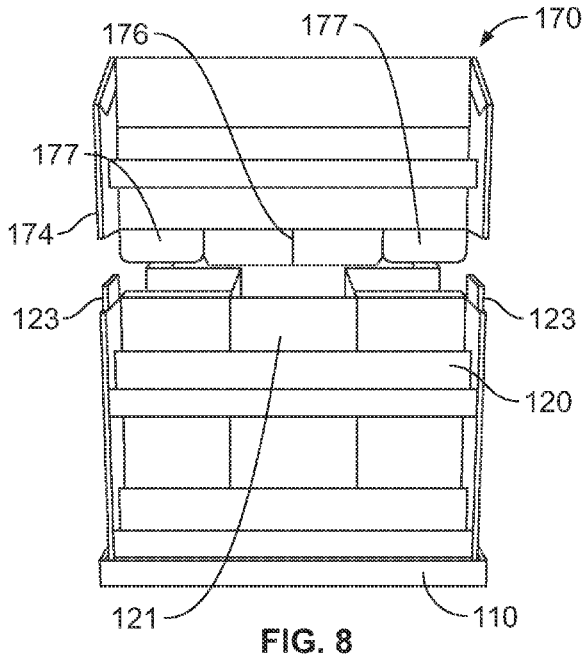
FIG. 8 is a side view showing the assembly of a large top upright and large bottom upright according to an embodiment of the invention.
Figure 8A:
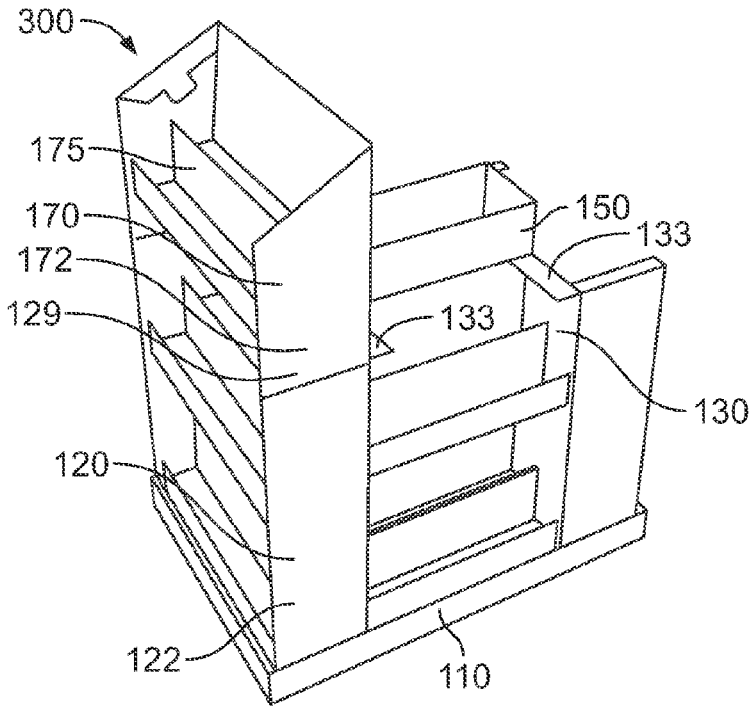
FIG. 8A is a top oblique view showing the completed assembly of a large top upright and large bottom upright according to an embodiment of the invention.
Figure 8B:
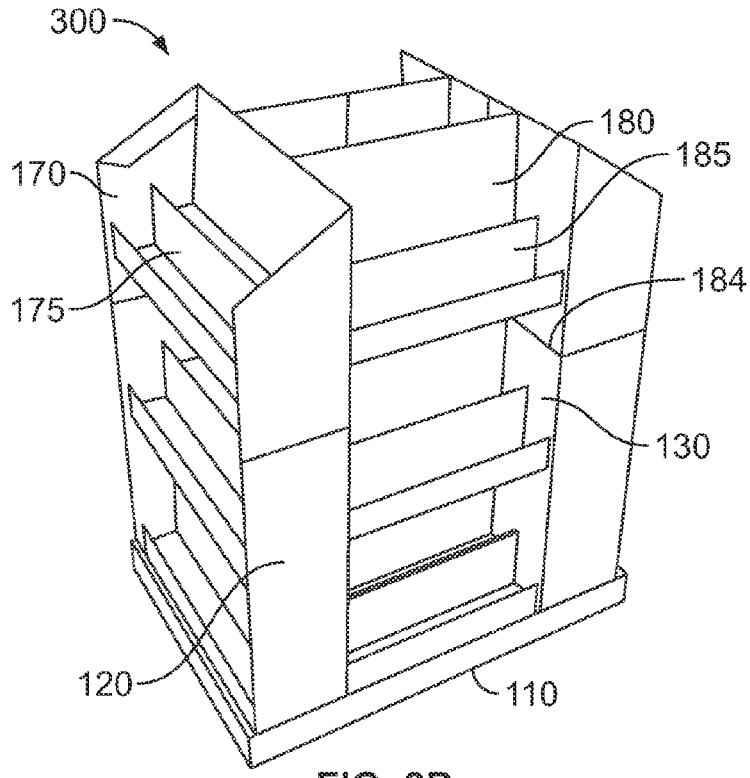
FIG. 8B is a top oblique view showing the completed assembly of small and large top uprights with small and large bottom uprights according to an embodiment of the invention.

FIGS. 8, 8A, and 8B show the assembly of the assembled display. Large top upright 170 is an open partial rectangular box with a back panel 171, and side panels 172. The side panels 172, as described previously have female slots 174 at their bottom ends. The large top upright also has center tab 176, and side tabs 177, all extending from the bottom of back panel 171. In this embodiment, the center tab 176 and side tabs extend all the way across the length of the back panel 171, with the center tab 176 being approximately the same length as the two side tabs 177.

When connecting the top and bottom large uprights, the end user turns the flanges 123 on the large bottom upright 120 upward, so that they will be inserted into the female slots 174 on the large top upright 170. The center tab 176 is fitted in front of the back panel 121, while the side tabs 177 are fitted behind the back panel 121. When completed, as shown in FIG. 8A, the large top upright 170 and large bottom upright appear to be a continuous upright, broken only by a seam 129 between the side panels 122 and 172.

The small top uprights 180 are assembled with small bottom uprights in parallel fashion. Flanges 133 on bottom uprights 130 are turned upward, and the center tab 186 of small top upright is fitted in front of back panel 131, and side tabs 187 are fit behind the back panel 131. The flanges 133 of bottom small upright fit into bottom female slots 184 of small top upright 180, resulting in the joining of small top upright 180 with small bottom upright 130 as shown in FIG. 8B. The display 300 is essentially complete, and product that was stored in the shipper filler 150 can be stocked on the shelves 175 and 185.

Figure 9:
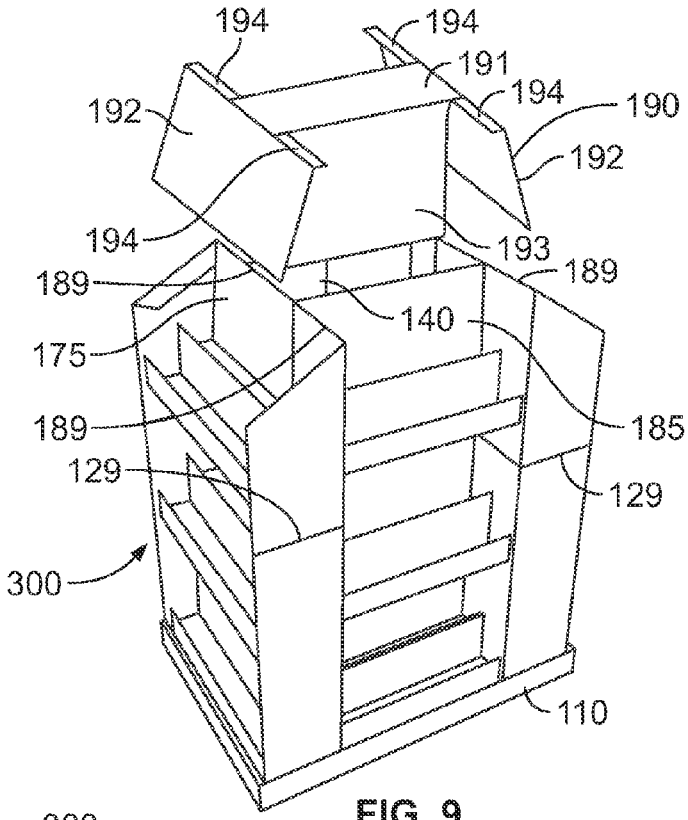
FIGS. 9-9A are top oblique views showing the assembly of a finishing H-piece on a display according to an embodiment of the invention.
Figure 9A:
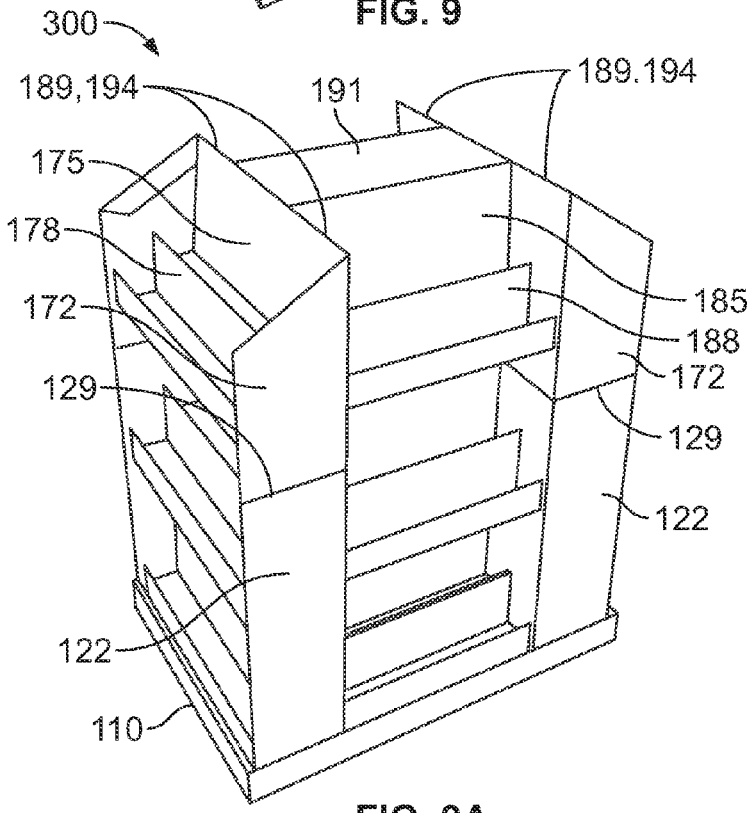

After both the small top uprights 180 and large top uprights have been installed, an H-piece 190 may be installed to provide a finished appearance to the top of display 300, which still has a center space 140 between the large and small top uprights 170 and 180. As shown in FIG. 9, the H-piece 190 comprises a center panel 191, two large flaps 192, two small flaps 193. The center panel is approximately the same dimensions as the center space 140, and will provide a top cover for the center space. Each large flap 192 has two flanges 194. The H-piece 190 is assembled by folding the large flaps 192 and small flaps 193 downward from the center panel, and tucking the large flaps 192 behind the false backs 175 of the large top uprights 170, and tucking the small flaps 193 behind the false backs 185 of the small top uprights 180. The flanges 194 are then folded downward and inserted into the top female slots 189 of the small top uprights 180. As shown in FIG. 9A, the display 300 now has a top cover 190 over the center space 140.

Figure 10:
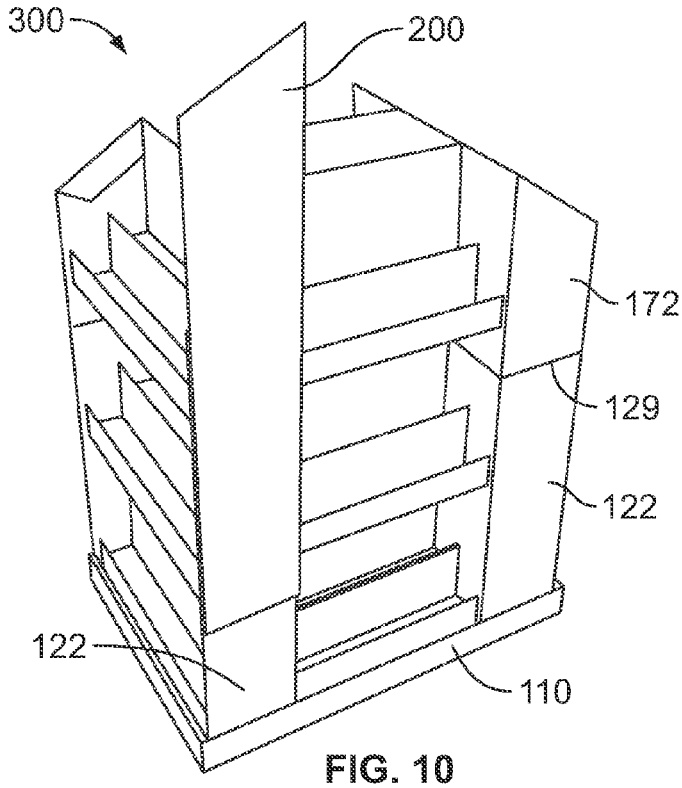
FIGS. 10-10A are top oblique views showing the assembly of finishing graphic panels on a display according to an embodiment of the invention.
Figure 10A:
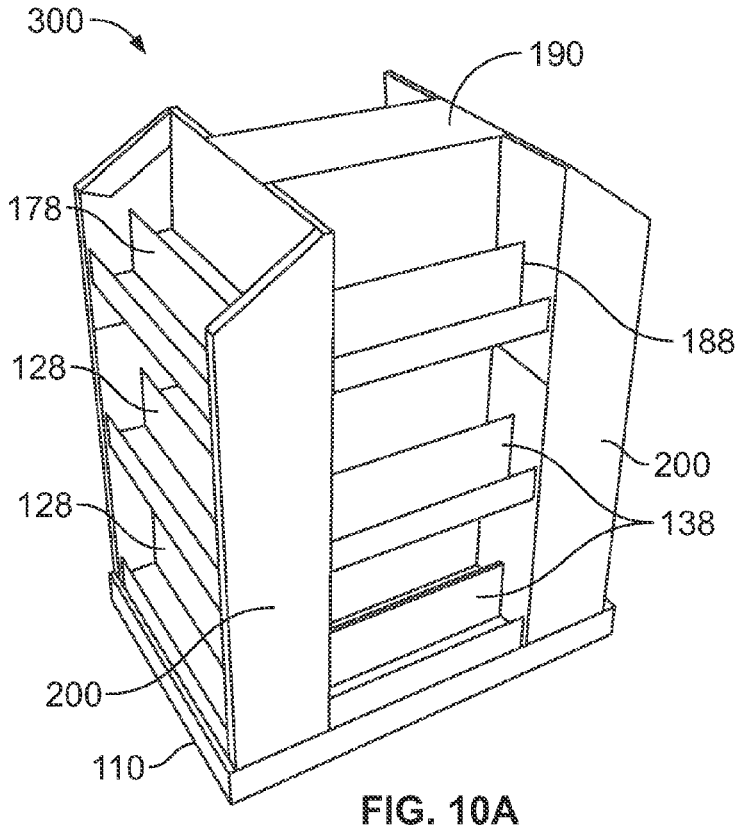

Four graphic panels 200 may also be applied as shown in FIG. 10 to cover the seams 129 between top large upright 170 and bottom large upright 120. These graphic panels may also have graphic matter printed thereon to draw attention to the display. These graphic panels 200 may be stowed along the long side of bottom tray 110 of the package 100 in transit. In the assembled display 300, as shown in FIG. 10, the graphic panels 200 are sized to cover the side panels 122 and 172 of the large bottom and top uprights 120 and 170. The graphic panels 200 may be installed by sliding the graphic panel 200 between the tray 110 and the side panels 122 and 172 as shown in FIG. 10. The graphic panels 200, once in place, are adhered to the side panels 122 and 172 using twinstick adhesive strips, resulting in the finished display 300 shown in FIG. 10A.

What is claimed is:

1. A compact package for a point-of-purchase display comprising:

a. a tray;

b. a plurality of bottom uprights disposed in the tray such that at least one space is formed between the bottom uprights;

c. a plurality of top uprights in disassembled form that are at least partially stowed in the at least one space between the bottom uprights;

wherein each of the top uprights may be removed from the at least one space between the bottom uprights, then assembled and secured on top of one of the bottom uprights to form assembled uprights in a point-of-purchase display.

2. The package according to claim 1, wherein the bottom uprights have products for display contained therein, and products for display on the top uprights are stowed in the at least one space between the bottom uprights.

3. The package according to claim 1, wherein the products for display on the top rack are stored in boxes having hand holes inside the at least one space between the bottom uprights.

4. The package according to claim 1, wherein the top uprights may be secured to the bottom portions without adhesive or external fasteners.

5. The package according to claim 3, wherein a top upright is secured to a bottom upright at least partially using flanges and slots.

6. The package according to claim 3, wherein the bottom upright has flanges extending upward that may be inserted into female slots on the top upright.

7. The package according to claim 3, wherein a top upright is secured to a bottom upright at least partially using tabs on the top upright that fit on opposite sides of a panel on the bottom upright.

8. The package according to claim 6, wherein the top upright has a center tab and two side tabs extending downward from the top upright, the center tab extending further downward than the two side tabs, and the center and side tabs fit on opposite sides of a panel on the bottom upright.

9. The package according to claim 1, further comprising a shroud and a cap for enclosing the package for transport.

10. The package according to claim 1, wherein the package is constructed essentially of corrugated board.

11. The package according to claim 1, wherein the package may be double-stacked on a standard tractor trailer.

12. The package according to claim 1, further comprising graphic panels that may be applied to the assembled uprights that cover scams where the top upright is secured to the bottom upright.

13. The package according to claim 1, further comprising a panel stowed in the package that may be unfolded and placed on top of the assembled display to cover any space between the top uprights.

* * * * *